US007752867B2

(12) United States Patent
Lehmann et al.

(10) Patent No.: US 7,752,867 B2
(45) Date of Patent: Jul. 13, 2010

(54) AIR RECIRCULATION SYSTEM FOR STATIONARY STORE ROOMS AND FOR CARGO SPACES OF REFRIGERATION SHIPS WITH HIGH-BAY RACKS

(75) Inventors: Dirk Lehmann, Winsen (DE); Siegmar Rodermund, Hohenfelde/Elmshorn (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 1068 days.

(21) Appl. No.: 11/356,305

(22) Filed: Feb. 16, 2006

(65) Prior Publication Data

US 2006/0207284 A1 Sep. 21, 2006

(30) Foreign Application Priority Data

Mar. 17, 2005 (DE) ..... 20 2005 004 501 U
Apr. 8, 2005 (DE) ..... 20 2005 005 817 U

(51) Int. Cl.
*F25D 17/06* (2006.01)

(52) U.S. Cl. ..... 62/419; 62/414

(58) Field of Classification Search ..... 62/419, 62/414, 411, 410

See application file for complete search history.

(56) References Cited

U.S. PATENT DOCUMENTS 2,529,651 A * 11/1950 Davis ..... 62/240
3,486,553 A 12/1969 Roberts
5,562,062 A * 10/1996 Upmeyer ..... 114/72

FOREIGN PATENT DOCUMENTS

EP 0298406 1/1989
GB 393345 6/1933
GB 2333828 8/1999

* cited by examiner

*Primary Examiner*—Melvin Jones
(74) *Attorney, Agent, or Firm*—Friedrich Kueffner

(57) ABSTRACT

In order to flush with cooling air the goods stacked or palletized in a high-bay rack placed in a stationary store room or in the cargo space of a refrigeration ship by maintaining a constant cooling temperature in all the layers, an air recirculation system is proposed for which two superimposed air circuits (40, 140; 40', 140') are configured in the area of every rack module (30; 130), whereby at least one rack module, preferably two rack modules (30; 130), are placed in the cargo space and whereby a shaft (50) for the rack stacker is assigned to each rack module (30; 130) or a shaft (50) for the rack stacker is placed between the two rack modules (30; 130) placed the one besides the other, whereby the shaft (50) serves a common pressure distribution chamber of the inlet air for each rack module (30; 130).

10 Claims, 3 Drawing Sheets

AIR RECIRCULATION SYSTEM FOR STATIONARY STORE ROOMS AND FOR CARGO SPACES OF REFRIGERATION SHIPS WITH HIGH-BAY RACKS

FIELD OF APPLICATION

This invention relates to an air recirculation system for stationary store rooms and for cargo spaces of refrigeration ships with high-bay racks for stacked or palletized goods.

PRIOR ART

Air recirculation systems in the cargo spaces of refrigeration ships have the aim to flush the cargo with cooled air and thus the whole cargo space too.

The quality conservation of the cargo during the transport determines an ambient temperature as constant as possible and a clean cargo space atmosphere. This is valid in particular for fruit freights. Here the air recirculation system should not only transfer the temperature but also take up the ripening warmth of the fruit and thus the development of maturity gas such as $CO_2$, acetylene, ethylene etc. This presupposes again that the cargo is effectively sufficiently flushed with cooling air in all the layers.

In the standard refrigeration ships, it is mostly reckoned with an air path through the cargo of approximately two to three meters. In these areas, the air paths can be very good controlled with channel ducts etc. There are also sufficient experiences for these systems. Because of their construction, high-bay racks on board of ships, in particular for the transport of fruit, are much more difficult to aerate in a controlled manner.

Aim, Solution, Advantage

Thus, the aim of this invention is to create an air recirculation system for stationary store rooms and for cargo spaces of refrigeration ships with high-bay racks for stacked or palletized goods with which it is guaranteed that the cargo is extensively flushed by cooling air by maintaining a constant cooling temperature in all the layers.

This aim is achieved with an air recirculation system for stationary store rooms and for cargo spaces of refrigeration ships with high-bay racks for stacked or palletized goods with the characteristics indicated in claim 1.

Accordingly, the air recirculation system according to the invention consists in that two superimposed air circuits are configured in the store room or in the cargo space of a refrigeration ship in the area of every rack module, whereby at least one rack module, preferably two rack modules, are placed in the cargo space and whereby a shaft for the rack stacker is assigned to each rack module or a shaft for the rack stacker is placed between the two rack modules, whereby the shaft serves a common pressure distribution chamber of the inlet air for each rack module.

Accordingly, the high-bay rack store space in a store room or on board ships is characterized in that there is a shaft for the rack stacker in front of each rack module and that it must be kept free. This shaft is used for the air recirculation system as air distribution shaft.

The air conduction system according to the invention consequently consists in two air circuits placed above each other. Each of these air circuits passes through an air cooler by means of the power of fans which are fixed on the opposed side of the shaft of the rack module.

Further advantageous configurations of the invention are the subject of the subclaims.

Thus, the junction of the two superimposed air circuits ends in front of the inlet side of the air coolers placed above each other. Each of the air circuits passes through an air cooler by means of the power of fans which are fixed on the opposed side of the shaft in front of the rack module.

The air conduction is such that for the upper air circuits the air coolers are flown through vertically upwards, whereby the air is guided into the shaft by a cover duct. The bottom walls of this cover duct are provided with air outlet openings so that a direct impact takes place onto the upper areas of the goods to be loaded or onto the pallets.

In the lower air circuit, the air is vertically guided through air coolers from the top to the bottom by fans as well, whereby the air is guided to the shaft through a bottom duct. Here too the upper wall of the bottom duct is provided with air outlet openings for the supply of the lowest layer of the goods to be stacked or of the pallets with freshly cooled air.

For the cooling of the outer walls of the store room or of the cargo space, the air ducts of the air circuits which are turned to the air coolers are configured in such a manner that part of the cold air is derived off for cooling the outer walls of the store room or of the cargo space.

Accordingly, in the air recirculation system according to the invention the air conduction is configured in such a manner that for the upper circuits the air coolers are flown through vertically upwards and the air is guided over the cover duct into the staple shaft. In the lower air circuit, the air is guided through the air coolers by the fans vertically from top to bottom and guided through a duct to the staple shaft as well.

With such an air recirculation system configured according to the invention, it is guaranteed that the high-bay rack warehouse as well as the store room or the cargo space are uniformly flushed with cooling air by maintaining constant predetermined temperatures so that the cargo is sufficiently cooled in all the layers.

Furthermore, the invention comprises a stationary store room or a cargo space of refrigeration ships with at least one high-bay rack, whereby the store room or cargo space is provided with an air recirculation system with the characteristics of claims 1 to 10.

SHORT DESCRIPTION OF THE DRAWINGS

Embodiments of the invention are represented in the drawings.

DETAILED DESCRIPTION OF THE INVENTION AND BEST WAY FOR CARRYING OUT THE INVENTION

Figure 1:
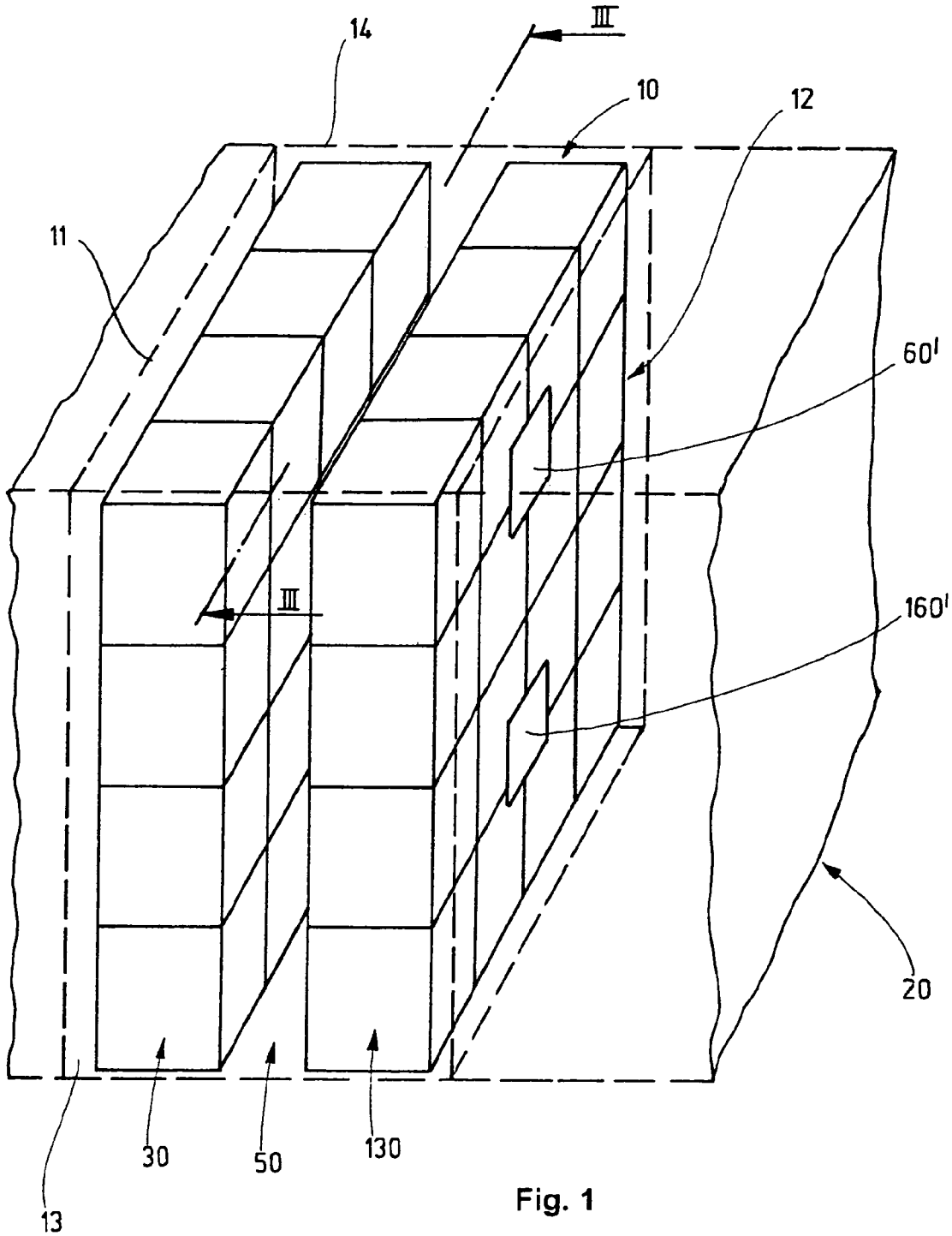
FIG. 1 shows a schematic graphical view of a ship cargo space with high-bay racks placed therein for preferably palettized goods.
Figure 2:
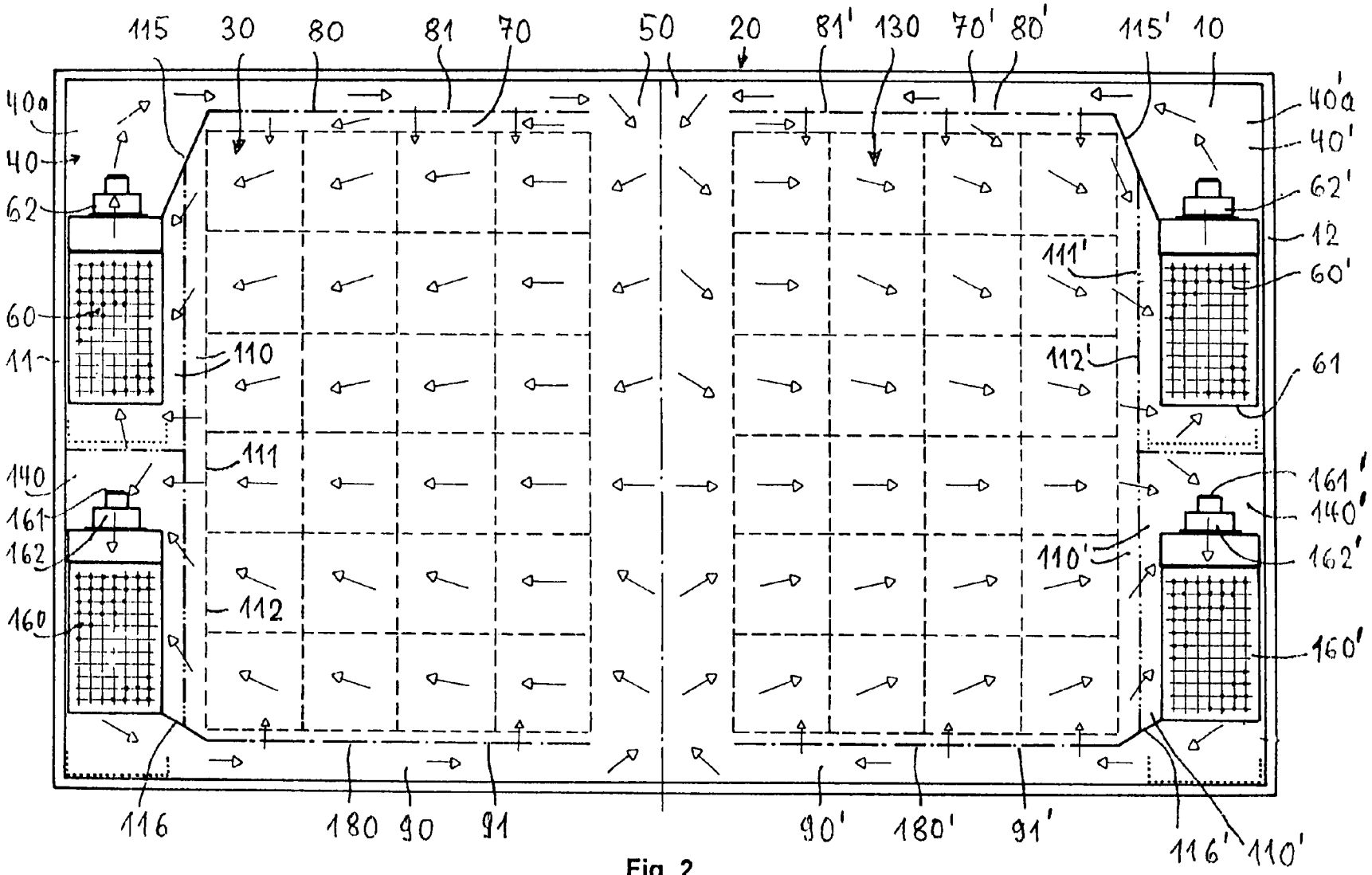
FIG. 2 shows the cargo space of a refrigeration ship with high-bay racks placed transversely to the ship longitudinal direction for stacked or palettized goods, whereby the cooling air currents are indicated by arrows.
Figure 3:
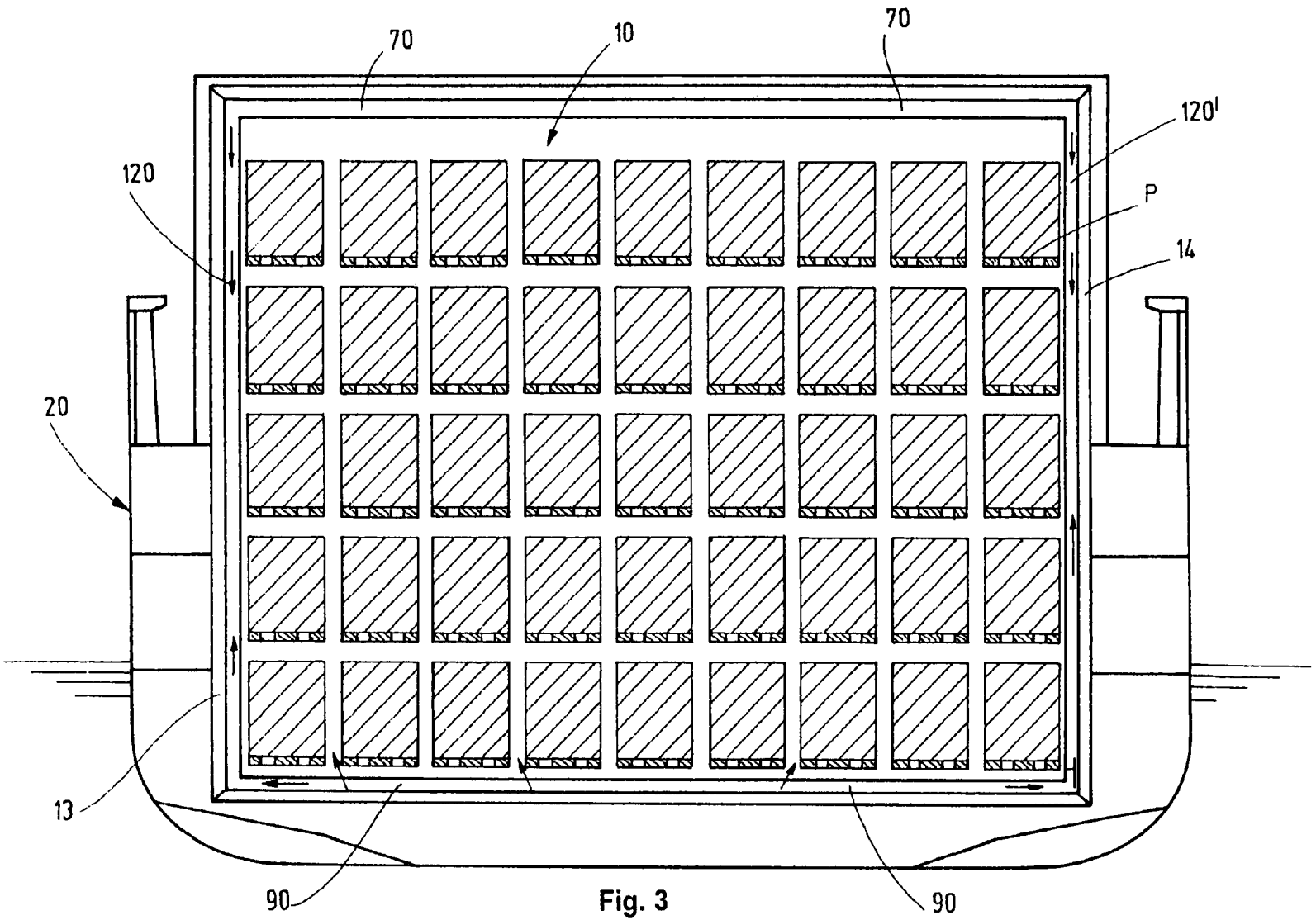
FIG. 3 shows a cross-section according to FIG. III-III through the ship refrigerating room with the goods palettized placed in the high-bay rack.

In FIGS. 1 and 2, 10 designates for example the cargo space of a refrigeration ship 20 with the side walls 11, 12 and the outer walls 21, 22. Two rack modules 30, 30 or high-bay racks are placed in the cargo space 10 which is enclosed on all sides by walls. A shaft 50 for rack stackers is configured between the two rack modules 30, 130. The rack modules 30, 130 receive preferably goods stacked on pallets P (FIG. 3).

Two superimposed air circuits 40, 140 and 40', 140' for cooling the cargo and the cargo space 10 are configured in the cargo space 10 in the area of each rack module 30, 130. The shaft 50 for the rack stacker is placed in front of each rack module 30, 30 or between the two rack modules 30, 130 placed the one besides the other. This shaft 50 serves as common pressure distribution chamber for the inlet air for each rack module 30, 130.

The junction of both superimposed air circuits 40, 140 or 40', 140' takes place in front of the inlet sides 61, 161 or 61', 161' of the superimposed air coolers 60, 160 or 60', 160' which run into the air circuits. Each of the air circuits 40, 140 or 40', 140' passes through an air cooler 60, 160, 60', 160' by means of the power of fans 62, 162 and 62', 162' which are fixed on the opposed side of the shaft 50 in front of the rack module 30, 130.

This being, the air conduction is such that for the upper air circuits 40*a*, 40'*a* the air coolers 60, 60' are flown through vertically upwards, whereby the air is guided into the shaft 50 by a cover duct 70, 70'. The bottom walls 80, 80' of the cover ducts 70, 70' are provided with air outlet openings 81, 81' so that a direct impact takes place onto the upper areas of the goods to be loaded or onto the pallets.

In the lower air circuit 140 or 140', the air is vertically guided through the air coolers 160, 160' from the top to the bottom by fans 162, 162' as well, whereby the air is guided to the shaft 50 through bottom ducts 90. 90'. The upper walls 180, 180' of the bottom ducts 90, 90' are provided with air outlet openings 91, 91' as well for the supply of the lowest layer of the goods to be stacked or of the pallets with freshly cooled air.

A cooling of the outer walls 13, 14 of the goods to be loaded 10 is also provided for. For the cooling of these outer walls 13, 14, the air ducts 110, 110' of the air circuits 40, 140 or 40', 140' which are turned to the air coolers 60, 160 or 60', 160' are configured in such a manner that a part of the cold air is derived off for cooling the outer walls 13, 14 of the cargo space 10. Cooling air side wall ducts 120,120' are provided for the cooling of the outer walls 13, 14 of the cargo space 10 (FIG. 3). Cooling air is fed over the cover duct 70 and the bottom duct 90 of the cargo space 10 to these side wall ducts 120, 120'. Cooling air is fed by the air coolers 60, 160 or 60', 160' to the two ducts 70. The cooling air conduction is indicated by arrows.

The walls 112, 112' of the air ducts 110, 110' turned to the air coolers 60, 160 or 60', 160' are also provided with air outlet openings 111, 111'.

As FIG. 2 further shows, the inside situated walls of the air coolers 60, 160 or 60', 160' pass over to the lower cover duct walls 80, 80' and the upper walls of the bottom ducts 90, 90' over inclined air guiding plates 115, 116 or 115', 116'

The air recirculation system according to the invention can be also used with the same good result for stationary store rooms.

LIST OF REFERENCE NUMERALS

10 Cargo space
11 Side wall
12 Side wall
13 Outer wall
14 Outer wall
20 Refrigeration ship
30 Rack module
130 Rack module
40 Upper air circuit
140 Lower air circuit
40' Upper air circuit
140' Lower air circuit
40*a* Upper air circuit
40'*a* Upper air circuit
50 Shaft
60 Air cooler
160 Air cooler
60' Air cooler
160' Air cooler
61 Inlet side
161 Inlet side
61' Inlet side
161' Inlet side
62 Upper fan
162 Lower fan
62' Upper fan
162' Lower fan
70 Cover duct
70' Cover duct
80 Lower cover duct wall
80' Lower cover duct wall
81 Air outlet openings
81' Air outlet openings
180 Upper wall
180' Upper wall
90 Bottom duct
90' Bottom duct
91 Air outlet openings
91' Air outlet openings
110 Air duct
110' Air duct
111 Air oulet openings
111' Air outlet openings
112 Wall
112' Wall
115 Guiding plate
115' Guiding plate
116 Guiding plate
116' Guiding plate
120 Side wall duct
120' Side wall duct
P Pallets

What is claimed is:

1. Air recirculation system for stationary store rooms and for cargo spaces for refrigeration ships with at least one high-bay rack for stacked or palletized goods, wherein two superimposed air circuits (40, 140; 40', 140') are configured in the store room or in the cargo space (10) of the refrigeration ship (20) in an area of every rack module (30; 130), whereby at least one rack module, preferably two rack modules (30; 130), are placed in the cargo space and whereby a shaft (50) for a rack stacker is assigned to each module (30; 130) or a shaft (50) for the rack stacker is placed between the two rack modules (30; 130) placed the one besides the other, whereby the shaft (50) serves a common pressure distribution chamber of inlet air for each rack module (30; 130), wherein a junction of the two superimposed air circuits (40, 140; 40', 140') ends in front of inlet sides (61, 161; 61', 161') of air coolers (60, 160; 60', 160') placed above each other, whereby the air circuits run into the inlet sides of air coolers, and wherein each of the air circuits (40, 140; 40', 140') passes through an air cooler (60, 160; 60', 160') by means of fans (62, 162; 62', 162') which are fixed on the opposite side of the shaft (50) in front of the rack modules (30, 130).

2. Air recirculation system according to claim 1, wherein air conduction is such that for upper air circuits (40*a*, 40'*a*) the air coolers (60, 60') are flown through vertically upwards, whereby the air is guided into the shaft by a cover duct (70, 70').

3. Air recirculation system according to claim 2, wherein bottom walls (80, 80') of the cover ducts (70, 70') are provided with air outlet openings (81, 81') so that a direct impact takes place onto upper areas of goods to be loaded or onto pallets.

4. Air recirculation system according to claim 2, wherein in a lower air circuit (140, 140') air is vertically guided through the air coolers (160, 160') from top to bottom by fans (162, 162'), whereby the air is guided to the shaft (50) through bottom ducts (90, 90').

5. Air recirculation system according to claim 4, wherein upper walls (180, 180') of the bottom ducts (90, 90') are provided with air outlet openings (91, 91') as well for supplying a lowest layer of goods to be stacked or of the pallets with freshly cooled air.

6. Air recirculation system according to claim 1, wherein for cooling of outer walls (11, 12) of the store room or of the cargo space (10), air ducts (110, 110') of the air circuits (40, 140; 40', 140') which are turned to the air coolers (60, 160; 60', 160') are configured in such a manner that part of the cold air is derived off for cooling the outer walls (11, 12) of the store room or of the cargo space (10).

7. Air recirculation system according to claim 6, wherein walls (112, 112') of the air ducts (110, 110') turned to the air coolers (60, 160; 60', 160') are provided with air outlet openings (111, 111').

8. Air recirculation system according to claim 6, wherein inside situated walls of the air coolers (60, 160; 60', 160') are connected with bottom walls (80, 80') of cover ducts (70, 70') and upper walls (180, 180') of bottom ducts (90, 90') over inclined air guiding plates (115, 116; 115', 116').

9. Air recirculation system according to claim 4, wherein for cooling of outer walls (13, 14) of the store room or of the cargo space (10), cooling air guiding side wall ducts (120, 120') are provided for to which cooling air is fed over the cover duct (70) and the bottom duct (90) of the store room or of the cargo space to which cooling air is fed over the air coolers (60, 160; 60', 160').

10. Stationary store room or cargo space of refrigeration ships with at least one high-bay rack for stacked or palletized goods, wherein the store room or the cargo space is provided with an air recirculation system according to claim 1.

* * * * *